US006019050A

United States Patent [19]

Ranta

[11] Patent Number: 6,019,050

[45] Date of Patent: Feb. 1, 2000

[54] PORTABLE AND ADJUSTABLE TABLE WITH IMPROVED LEG ASSEMBLY

[76] Inventor: Jouko Y. Ranta, P.O. Box 114, Morristown, Ariz. 85342

[21] Appl. No.: 09/153,727

[22] Filed: Sep. 15, 1998

[51] Int. Cl.[7] ..... A47F 5/12

[52] U.S. Cl. ..... 108/6; 108/115

[58] Field of Search ..... 100/6, 10, 3, 2, 100/115; 248/454, 457, 448, 477, 279.1, 277.1

[56] References Cited

U.S. PATENT DOCUMENTS

| | | | |
|---|---|---|---|
| 1,719,614 | 7/1929 | McIntosh . | |
| 2,449,492 | 9/1948 | Long . | |
| 2,476,620 | 7/1949 | Nichols . | |
| 3,164,353 | 1/1965 | Rene . | |
| 3,698,328 | 10/1972 | Weir | 108/6 |
| 3,805,710 | 4/1974 | Leshem . | |
| 4,119,289 | 10/1978 | Kanocz . | |
| 4,196,675 | 4/1980 | Cook . | |
| 4,248,161 | 2/1981 | Adair et al. . | |
| 4,383,486 | 5/1983 | Reineman et al. | 108/6 X |
| 4,726,556 | 2/1988 | Weir . | |
| 5,417,168 | 5/1995 | Soper . | |
| 5,573,590 | 11/1996 | Soper | 108/6 X |

FOREIGN PATENT DOCUMENTS

| | | | |
|---|---|---|---|
| 283083 | 9/1952 | Switzerland | 108/6 |

*Primary Examiner*—Jose V. Chen
*Attorney, Agent, or Firm*—Steven Lin

[57] ABSTRACT

An adjustable and portable table 10 with improved foldable leg assembly 20. The leg assembly 20 supports a table surface 12. The leg assembly 20 includes a mounting bar 18, a first angled leg component 40, and a second angled leg component 40. The second leg component 40 is able to rotate relative to at least a portion of the mounting bar 18 so that the second leg component 40 is out of a way of the first leg component 40 when the first and second leg components are being folded to the storage position. The first and second leg components 40 are able to be unfolded to a usable position. The mounting bar 18 further has a first bar portion 24 to which the first leg component 40 is coupled and a second bar portion 26 to which the second leg component 40 is coupled. The second bar portion 26 rotates relative to the first bar portion 24. The first bar portion 24 and the second bar portion 26 are able to be placed in rotational lock and unlock positions. Height adjustment components 64 with a hollow structure 65, an engaging protuberance 66, and a spring component 68 are each coupled to the leg components 40 to allow for height adjustment. The height adjustment components 40 allow for independent height adjustment of the leg components 40 to level a horizontal level plane of the mounting bar 18 when the leg components 40 are placed on even and uneven surfaces. The leg assembly 20 has a base distance width between the leg components 40 which increases as lengths of the leg components 40 increase and decreases as the lengths of the leg components 40 decrease. A table adjustment mechanism 25, which includes at least one adjustment knob, a washer ring, and at least one friction plate having a concave friction surface, allows angular and pitch adjustment of the table surface 12 coupled to the mounting bar 18.

27 Claims, 5 Drawing Sheets

PORTABLE AND ADJUSTABLE TABLE WITH IMPROVED LEG ASSEMBLY

FIELD OF INVENTION

The present invention relates to portable and adjustable tables or support structures, and in particular, to a portable and adjustable table or support structure with improved leg assembly.

BACKGROUND OF INVENTION AND BRIEF DESCRIPTION OF THE PRIOR ART

Portable and/or foldable tables have existed to provide users with an easily foldable/unfoldable table structure that provides table surfaces for a wide variety of uses and purposes and convenience to the users. These tables may be typically used at places or locations where conventional tables cannot be used. Such tables are used for working, reading/writing, eating, or any other purposes. Common uses of such tables are for placing and supporting laptop or portable computers, books, plates, bowls, or any other such items.

For example, laptop or portable computers are used by various persons. Laptop computer users often prefer to use their portable computers while sitting in a comfortable chair/couch or while sitting up or lying in a bed. These locations, however, typically require a table or desk on which the computer is placed, or the user must position the computer on his or her lap. Supporting a portable computer on the user's lap is awkward or uncomfortable and causes heat, sweat, muscle fatigue, etc. to the user. Therefore, portable computer users generally prefer to use some type of portable table, stand, support device, or other flat, rigid surface upon which the computer is placed.

U.S. Pat. Nos. 1,719,614; 2,449,492; 2,476,620; 3,805,710; 4,119,289; 4,726,556; 5,417,168; disclose examples of such portable and/or adjustable tables or support structures. These prior art patents are incorporated by reference herein. However, there are various problems and disadvantages with these prior art portable tables or support structures. Some of these prior art tables and support structures are uncomfortable and bulky to use, cumbersome to set up, or not easily or variably adjustable to accommodate all users of various heights and sizes.

Some of the prior art tables and support structures required attachment or coupling to another surface or structure in order to be used. Portable tables and support structures that are collapsible and folding and self-supporting and self-standing have been developed and exist in the prior art. U.S. Pat. Nos. 2,476,620; 3,805,710; 4,726,556; 5,417,168 disclose examples of such self-supporting or self-standing, collapsible tables and support structures. However, one problem with these self-supporting, collapsible prior art tables is that the legs or leg components are not able to be easily folded together since one leg or leg component would get in the way of rotation or folding of the other leg or leg component when the legs or leg components were being placed into a storage position. The folded legs were therefore bulky, or one of the legs needed to be removed in order to fold or place the legs in a compact position. Therefore, the need and desire exists to develop and provide a leg assembly for a table or support structure wherein the leg components stay coupled to the leg assembly and wherein the leg components are able to be put into a folding position and rotate or fold easily out of the way of each other when being folded to a compact storage position and are able to rotate back to an unfolding position for use.

Also, some of the prior art tables or support structures have foldable or collapsible legs or leg assemblies that may not be very stable or balanced when in use. Therefore, collapsible truss structures or collapsible triangular shaped leg components have been developed and used for various tables and support structures. U.S. Pat. Nos. 3,164,353 and 4,726,556 provide examples of such legs or leg assemblies. U.S. Pat. No. 3,164,353 is further incorporated by reference herein. However, one problem with these legs or leg assemblies is that the stability, balance, and center of gravity position of the table or support structure may become less stable as the table or support surface is raised or lowered to a various position. Therefore, the need and desire exists to develop and provide a leg assembly for a table or support structure wherein the legs or leg components and the center of gravity position of the leg assembly remain generally stable and balanced whether the table or support structure surface is raised or lower.

Furthermore, prior art tables or support structures that allow for height adjustment exist in order to accommodate the user. U.S. Pat. Nos. 2,449,492; 2,476,620; 3,805,710; 4,119,289; 4,726,556; 5,417,168 provide examples of such height adjustable tables or support structures. However, some of the prior art height adjustment mechanisms for these tables or support structures are cumbersome, awkward, or difficult to use. U.S. Pat. No. 5,417,168 discloses a height adjustment mechanism that uses an engaging protuberance to one of a number of height adjustment holes in order to adjust the height of each leg component. However, this height adjustment mechanism has the problem of aligning the engaging protuberance to a certain/desired height adjustment hole. Therefore, the need and desire exists to develop and provide a height adjustment mechanism for a table or support structure that is easily accessible and easy to use to adjust height of the table and able to easily align and engage the engaging protuberance into a certain/desired height adjustment hole.

A further limitation of the prior art tables or support structures is that they do not explicitly teach or disclose legs or leg components that are independently adjustable to conform the plane of the table or support structure surface to even and uneven surfaces (i.e. bed or mattress surface or any other such even/uneven surfaces). Another limitation of the prior art tables or support structures is that they do not adjust to the size and height of the user in that the width distance apart from the legs or leg components are not adjustable when the height of the table or support structure surface is lowered or raised. Also, a mechanism for adjusting the angle or pitch of the table or support structure surface is in continual need of improvement and development.

Therefore, the present invention discloses and provides a portable and adjustable table or support structure with an improved leg assembly that overcomes the above problems, disadvantages, and limitations of the prior art.

SUMMARY OF INVENTION

Set forth is a brief summary of the invention in order to solve the foregoing problems and achieve the foregoing and other objects, benefits, and advantages in accordance with the purposes of the present invention as embodied and broadly described herein.

It is an object of the invention to provide a portable and adjustable table with an improved leg assembly.

It is an object of the invention to provide an improved leg assembly wherein the leg components stay coupled to the leg assembly and wherein the leg components are able to be put into a folding position and easily rotate or fold out of the way of each other when being folded to a neat, compact storage position and are able to rotate back to an unfolding position for use.

It is a further object of the invention to provide a leg assembly for a table or support structure wherein the legs or leg components and the center of gravity position of the leg assembly remain generally stable and balanced whether the table or support structure surface is raised or lower.

It is another object of the invention to provide a height adjustment mechanism for an adjustable table or support structure that is easily accessible and easy to use and able to easily align and engage the engaging protuberance into a certain/desired height adjustment hole.

It is still another object of the invention to provide legs or leg components for leg assembly of a table or support structure that are independently adjustable to conform or level the plane of the table or support structure surface when the leg assembly is placed on even and uneven surfaces (i.e. bed or mattress surface or any other such even/uneven surfaces).

It is still a further object of the invention to provide a table or support structure that accommodates the user in adjusting to the size and height of the user in that the width distance apart from the legs or leg components are respectively adjustable when the height of the table or support structure surface is lowered or raised.

It is still another object of the invention to provide an improved mechanism for adjusting the angle or pitch of the table or support structure surface.

The above and other objects are achieved by an improved foldable leg assembly for supporting a table surface. The leg assembly includes a mounting bar adapted to receive the table surface, a first leg component foldably coupled to the mounting bar, and a second leg component foldably coupled to the mounting bar. The first leg component and the second leg component are foldable to a storage position and unfoldable to a usable position. The second leg component is able to rotate relative to at least a portion of the mounting bar so that the second leg component is out of a way of the first leg component when the first leg component and the second leg component are being folded to the storage position. The second leg component is also able to rotate relative to the portion of the mounting bar so that the second leg component is able to rotate back relative to the portion of the mounting bar when the first leg component and the second leg component are being unfolded to the usable position.

The mounting bar further has a first bar portion to which the first leg component is coupled and a second bar portion to which the second leg component is coupled. The second bar portion rotates relative to the first bar portion so that the second leg component is able to rotate relative to the first bar portion such that the second leg component is out of the way of the first leg component when the first leg component and the second leg component are being folded to the storage position and so that the second leg component is able to rotate back relative to the first bar portion when the first leg component and the second leg component are being unfolded to a usable position. The first bar portion further includes a screw located and attached by use of an attaching pin to a general end of the first bar portion, and the second bar portion further includes a receiving threaded portion located and attached by use of another attaching pin at a general end of the second bar portion. The screw rotates within the receiving threaded portion so that the first bar portion rotates relative to the second bar portion. A rotational lock component is slidingly coupled to the first bar portion and the second bar portion. The rotational lock component is able to slide to both the first bar portion and the second bar portion to lock the first bar portion and the second bar portion into a rotational lock position and to slide the rotational lock component away from the first bar and to only the second bar to a rotational unlock position. A spring component is embedded at a surface of the second bar portion such that the rotational lock component is always located and is able to slide over the spring component. The spring component holds the rotational lock component in a spring bias position to the second bar portion.

Height adjustment components are each coupled to the first leg component and the second leg component wherein the height adjustment components allow adjustment of height of the first leg component and height of the second leg component. Height adjustment holes are located on the lower support leg portions of the first leg component and the second leg component that allow the lower support leg portions to slidably move relative to the upper support leg portions of the first leg component and the second leg component. The height adjustment components each further includes a hollow structure placed to surround an end of each of the upper support leg portions, an engaging protuberance coupled to an interior side of the hollow structure, and a spring component having one end attached to another interior side of the hollow structure and having another end attached at each of the upper support leg portions. The height adjustment components may be independent height adjustment components that allow the first leg component and the second leg component to be adjusted independently in height to conform a horizontal level plane of the mounting bar to even and uneven surfaces.

The improved foldable leg assembly further provides a leg assembly that has a base distance width between the first leg component and the second leg component which increases as lengths of the first leg component and the second leg component increase and wherein the base distance width decreases as the lengths of the first leg component and the second leg component decrease. Also, the improved foldable leg assembly has a table adjustment mechanism that allows angular or pitch adjustment of the table surface coupled to the mounting bar. The table adjustment mechanism includes at least one adjustment knob rotatingly screwed and coupled to each end of the mounting bar and at least one friction plate having a concave friction surface attached to each end of the mounting bar. A washer ring is coupled between the knob and the friction plate wherein frictional force is focused towards an outer perimeter of the friction plate when the knob is being tightened to hold the table surface in place. Furthermore, the leg assembly includes first and second leg components that are outwardly and angularly coupled to the mounting bar.

The above and other objects are further achieved by an improved leg assembly for a table that has a mounting bar adapted to receive a table surface and at least two height adjustable legs coupled to the mounting bar. A base distance width between the at least two adjustable legs increases as lengths of the at least two adjustable legs increase. and the base distance width decreases as the lengths of the at least two adjustable legs decrease.

The above and other objects are also achieved by a method of folding and unfolding an improved foldable leg assembly that supports a table surface. A foldable leg assembly is provided with a mounting bar adapted to receive the table surface, a first foldable leg component hingedly coupled to the mounting bar, and a second foldable leg component hingedly coupled to the mounting bar. The first leg component and the second leg component are each collapsed to a folded position. The second leg component is rotated relative to the first leg component so that the second leg component is rotated out of a way of the first leg component when the first leg component and the second leg component are being folded to a storage position. The second leg component is rotated relative to the first leg component so that the first leg component and the second leg component are able to rotate back to an unfolding position when the first leg component and the second leg component are being unfolded to an usable position. The first leg component and the second leg component are each expanded to an unfolded position when being placed into the usable position.

The above and other objects are further achieved by a method of using an improved leg assembly for a table. The improved leg assembly is provided with a mounting bar having a table surface attached thereto and at least two height adjustable legs coupled to the mounting bar. Lengths of the at least two height adjustable legs are increased to make the table surface higher thereby increasing a base distance width between the at least two adjustable legs. Lengths of the at least two height adjustable legs are decreased to make the table surface lower thereby decreasing a base distance width between the at least two adjustable legs.

The above and other objects are also achieved by a table with an improved foldable leg assembly. The leg assembly has a mounting bar, a table surface coupled to the mounting bar, a first leg component coupled to the mounting bar, and a second leg component coupled to the mounting bar. The second leg component is able to rotate relative to the first leg component. The first and second leg components are folded to a storage position so that the second leg component is out of a way of the first leg component when the first leg component and the second leg component are being folded to the storage position. The first and second leg components are unfolded to an usable position so that the first and second leg components are able to rotate back to an unfolding position when the first and second leg components are being unfolded to the usable position.

The preferred embodiments of the inventions are described below in the Figures and Detailed Description. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Detailed Description is not intended to indicate a desire to invoke the special provisions of 35 U.S.C. Section 112, paragraph 6 to define the invention. To the contrary, if the provisions of 35 U.S.C. Section 112, paragraph 6, are sought to be invoked to define the inventions, the claims will specifically state the phrases "means for" or "step for" and a function, without also reciting in such phrases any structure, material, or act in support of the function. Even when the claims recite a "means for"or "step for" performing a function, if they also recite any structure, material or acts in support of that means of step, then the intention is not to invoke the provisions of 35 U.S.C. Section 112, paragraph 6. Moreover, even if the provisions of 35 U.S.C. Section 112, paragraph 6, are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function.

DETAILED DESCRIPTION

Figure 1:
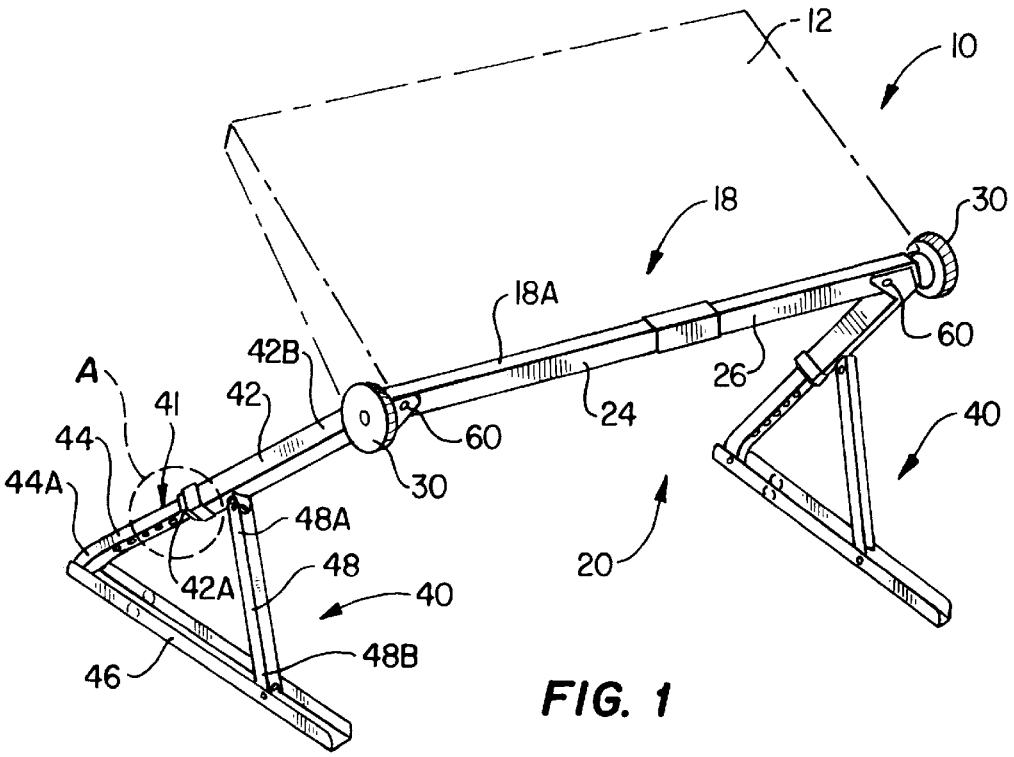
FIG. 1 is a perspective view of the present invention improved leg assembly for a portable and adjustable table.
Figure 2:
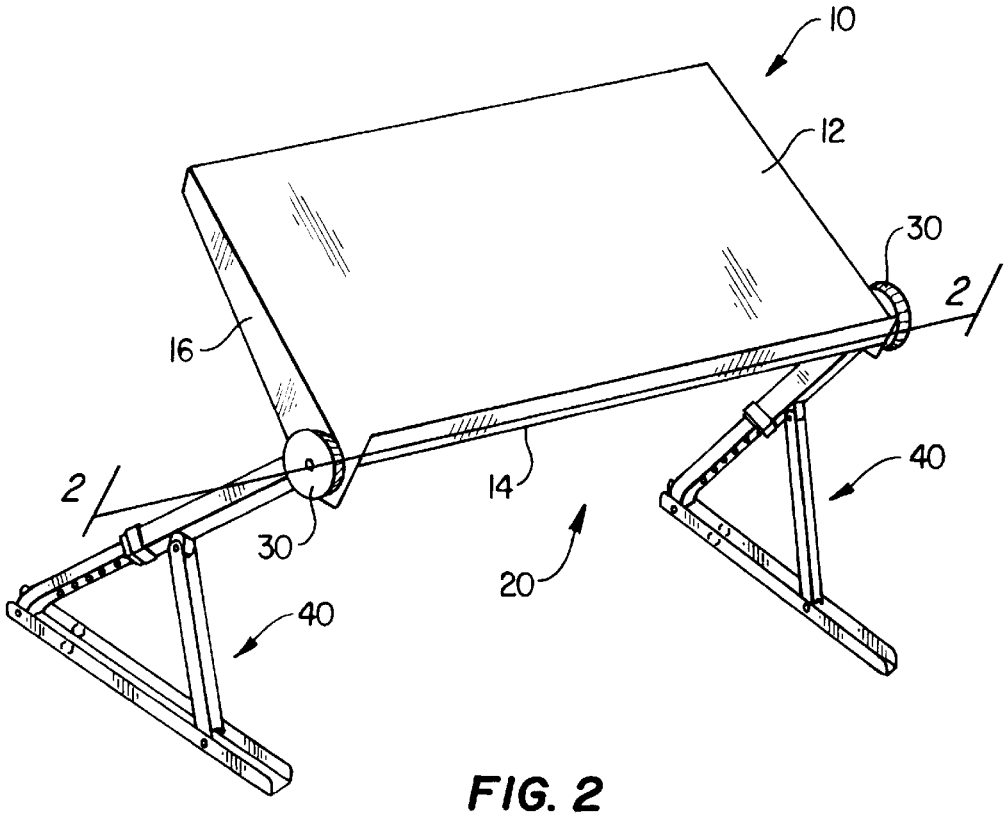
FIG. 2 is a perspective view of the portable and adjustable table with improved leg assembly of FIG. 1.
Figure 3:
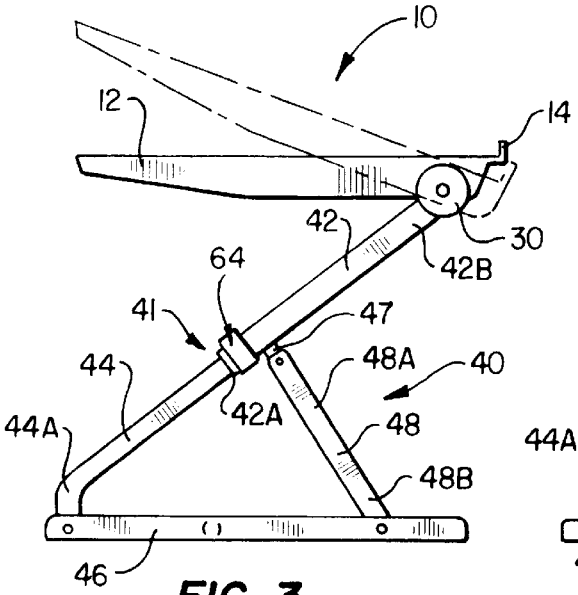
FIG. 3 is a side view of the portable and adjustable table of FIG. 2 in a fully extended, unfolded, and expanded position.

The present invention is a table 10 with an improved leg assembly 20 as shown in the figures. In FIGS. 1, 2, and 10, the improved leg assembly 20 has leg components 40 that are hingedly coupled to a mounting bar 18 via hinge attachment screw components 60 which allow the leg components 40 to be folded inwardly to a storage position for storage or transport and unfolded and expanded outwardly to an usable position when the table 10 is being used. FIG. 2 shows the table 10 having a table surface 12 hingedly coupled to the mounting bar 18 of the improved leg assembly 20. The table surface 12 includes mounting side tabs 16. The ends of the mounting bar 18 are respectively coupled to the mounting side tabs 16 of the table surface 12 via adjusting knobs 30. Referring to FIG. 3, the adjusting knobs 30 are loosened to adjust the angle, pivot, or pitch of the table surface 12 and tightened to hold the table surface 12 in a certain or desired position. Also, shown in FIGS. 2, 3, 4, 8, 9, and 10, the table surface 12 further has a stopping surface 14 that is located at or near the pivot or pitch line 2—2 of the table surface 12 (i.e. along the mounting bar 18) to hold a laptop computer, book, or any other articles on the table surface 12 when the table surface 12 is angled or pivoted in a generally upwardly slanted or pivoted position.

Figure 4:
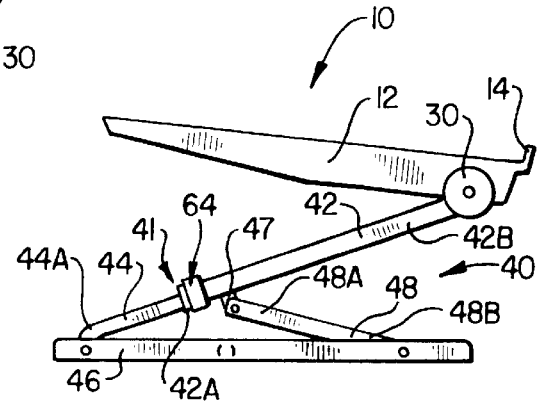
FIG. 4 is a side view of the portable and adjustable table of FIG. 2 being folded and compacted to a lower position.

Referring to FIGS. 3 and 4, each leg component 40 is in a form of a truss shaped structure (i.e. tilted "A" shape or other suitable shape). Each leg component 40 has a slidably adjustable support leg bar 41, a base leg bar 46, and a cross support leg bar 48. These bars are coupled together to form the truss or triangular shaped structure as shown in the figures. The slidably adjustable support leg bar 41 has a lower support leg portion 44 and an upper support leg portion 42 as shown in FIGS. 1, 3, and 4. At end 42A, the upper support leg portion 42 is slidably coupled over the lower support leg portion 44. At end 42B, the upper support leg portion 42 is hingedly coupled to the mounting bar 18. The base leg bar 46 is hingedly coupled to an end 44A of the lower support leg portion 44. A cross support bar 48 provides support and a cross-structure for the leg components 40. The cross support bar 48 is hingedly coupled at one end 48A to a coupling member 47. The coupling member 47 is attached and protrudes from the upper support leg portion 42. The other end 48B of the cross support bar 48 is hingedly coupled to the base leg bar 46. The leg components 40 are collapsible to a folded position as being shown in FIG. 4 and are expandable to an unfolded position as shown in FIG. 3. The cross support bar 48 folds into the base leg bar 46 and the slidably adjustable support leg bar 41 folds down to a horizontal position when the leg component 40 is being collapsed into the folded position (i.e. see FIG. 15), and the cross support bar 48 unfolds from the base leg bar 46 and the slidably adjustable support leg bar 41 unfolds up to an angled position when the leg component 40 is being expanded to an unfolded position (i.e. see FIG. 14).

Figure 5:
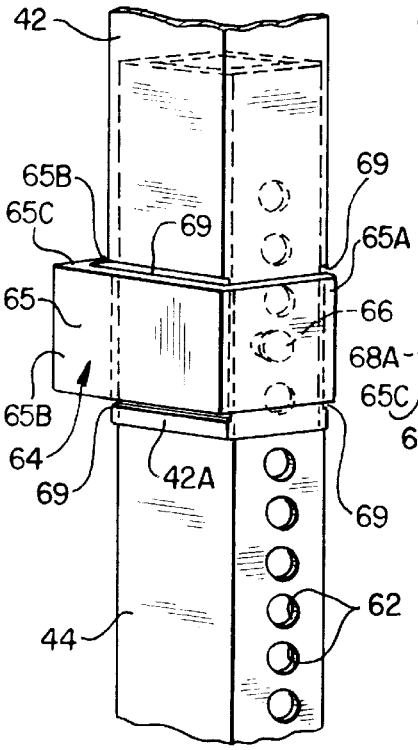
FIG. 5 is a detailed view of the portion of the leg component defined by the circle A of FIG. 1.
Figure 6:
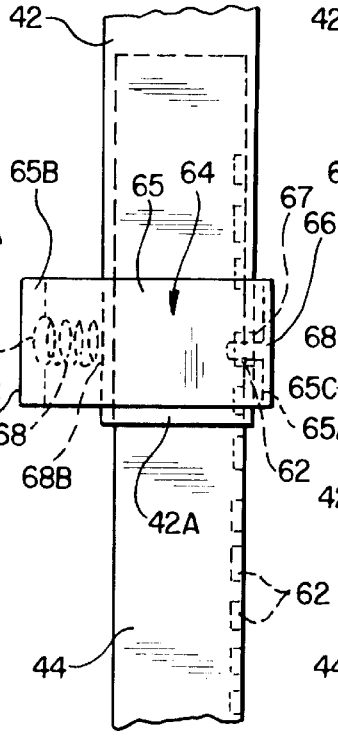
FIG. 6 is a side plan view of the portion of the table leg component of FIG. 5 showing the height adjustment apparatus in a normal spring bias engaging position.
Figure 7:
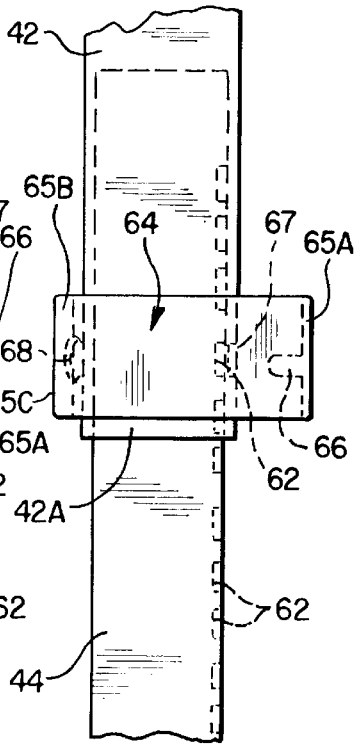
FIG. 7 is a side plan view of the portion of the table leg component of FIG. 5 showing the height adjustment apparatus in a spring-compressed, unlocked position.

Referring to FIGS. 5–7, the slidably adjustable support leg bar 41 of each leg component 40 has a height adjustment component 64 for adjusting the height/length of each leg component 40. The height adjustment component 64 allows the lower support leg portion 44 to be insertingly adjusted inwardly to or outwardly from and to be held in place relative to the upper support leg portion 42. Adjustment holes 62 are provided in the lower support leg portion 44 to allow the lower support leg portion 44 to be secured in a position relative to and released from the upper support leg portion 42 by the height adjustment component 64. The height adjustment component 64 is coupled to the upper support leg portion 42. In FIG. 5, two sides of the height adjustment component 64 are slidingly coupled to the grooves 69 of the upper leg portion 42 near end 42A to hold and allow sliding of the hollow rectangular structure 65 relative to and within the general end 42A of the upper leg portion 42.

As shown in FIGS. 5–7, the height adjustment component 64 has a hollow rectangular structure 65, an engaging protuberance 66, and a spring component 68. The hollow rectangular structure 65 is placed to surround and slidingly couple to the upper support leg portion 42 at its end 42A. The engaging protuberance 66 is coupled to an interior side 65A of the hollow rectangular structure 65. The engaging protuberance 66 inserts through the access hole 67 of the upper support leg portion 42 and engages into one of the adjustment holes 62 when the height adjustment component 64 is positioned into a height locked position so that the slidably adjustable support leg bar 41 of the leg component 40 is held at a certain or desired length/height as shown in FIGS. 5 and 6. The engaging protuberance 66 disengages from one of the adjustment holes 62 and disengages from the access hole 67 when the height adjustment component 64 is positioned into a height unlocked position so that the upper portion 42 and the lower portion 44 of the slidably adjustable support leg bar 41 are able to slide to adjust the slidably adjustable support leg bar 41 in length/height as shown in FIG. 7. The spring component 68 has one end 68A attached to the interior side 65B of the hollow rectangular structure 65 and has another end 68B attached at general end 42A of upper portion 42 of slidably adjustable support leg bar 41 as shown in FIG. 6.

In FIG. 7, the spring component 68 is compressed when pressure is applied on exterior side 65C of the hollow rectangular structure 65 causing the hollow rectangular structure 65 to slide along the groove areas 69 of the upper leg portion 42. When the hollow rectangular structure 65 slides and the spring component 68 is compressed, the engaging protuberance 66 disengages from one of the adjustment holes 62 and from the access hole 67 of the upper leg portion 42 to allow the slidably adjustable support leg bar 41 to adjust to various lengths/heights as shown in FIG. 7. In FIG. 6, the spring component 68 is returned to a normal spring bias position when the pressure is released on the hollow rectangular structure 65 and the hollow rectangular structure 65 slides back to a spring bias normal position. When the hollow rectangular structure 65 has slid back and the spring component 68 has returned to its normal spring bias position, the engaging protuberance 66 slides through the access hole 67 of upper leg portion 42 and engages into one of the adjustment holes 62 to hold the slidably adjustable support leg bar 41 at the certain or desired length/height. The access hole 67 is provided in the upper leg portion 42 near end 42A so that the engaging protuberance 66 is able to access and engage through the upper leg portion 42 and to one of the adjustment holes 62.

The length of each leg component 40 is adjusted by simply depressing the height adjustment component 64 inwardly on exterior side 65C as shown in FIG. 7 thereby releasing or disengaging the engaging protuberance 66 from a respective adjustment hole 62 and the access hole 67 to allow the lower leg portion 44 of the slidably adjustable support leg bar 41 to be adjusted to a desired position within the upper support leg portion 42. The height adjustment apparatus 64 is then released and the tension of the spring 68 causes the engaging protuberance 66 to engage through the access hole 67 and into a certain/desired adjustment hole 62, thereby locking the lower leg portion 44 into the upper support leg portion 42 as shown in FIG. 6. The leg components 40 may be adjusted independently from one another to conform and a top horizontal plane at side 18A of the mounting bar 18 (i.e. see FIG. 1) when the leg components are on either an even or uneven surface. In other words, the leg components 40 are adjusted to the same height/length when they are placed on an even surface, and the leg components 40 are adjusted to appropriate different heights/lengths when they are placed on an uneven surface.

Figure 8:
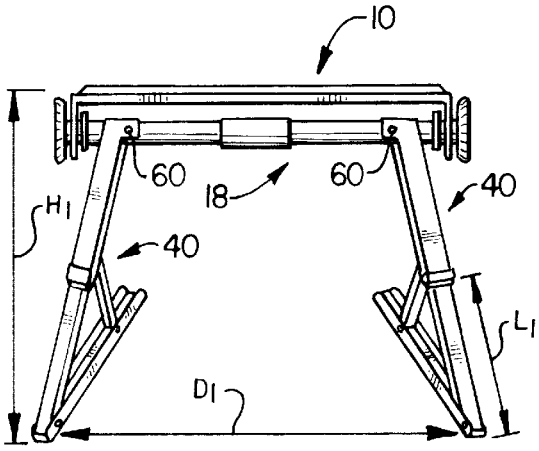
FIG. 8 is a front view of the portable and adjustable table of FIG. 2 in a raised position.
Figure 9:
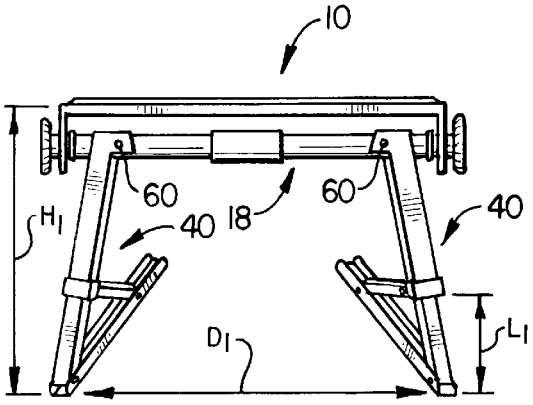
FIG. 9 is a front view of the portable and adjustable table of FIG. 2 in a lowered position.
Figure 10:
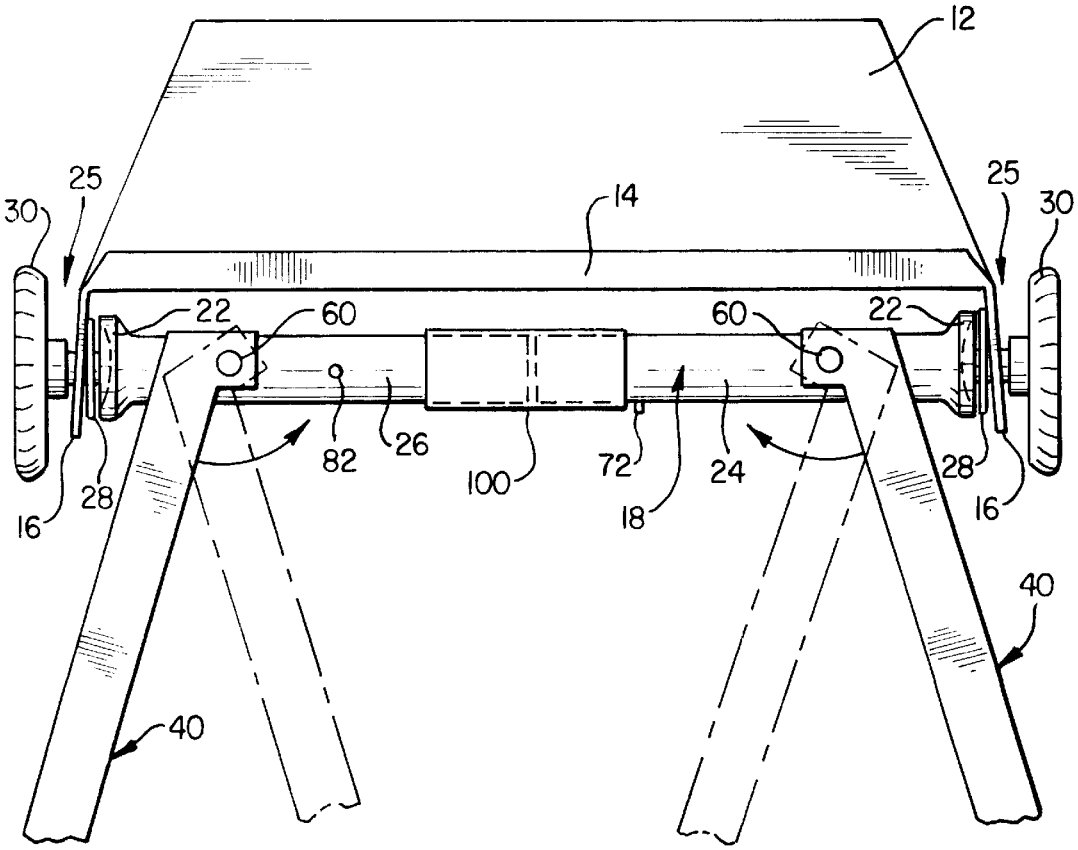
FIG. 10 is a partial rear view of the portable and adjustable table of FIG. 2 showing the mounting bar components and the table adjustment mechanism components.

Referring to FIGS. 8 and 9, the leg components 40 are hingedly coupled to the mounting bar 18 in an outwardly angled position that provides a wide, stable support base for the resting surface 12. Because the leg components 40 are angled outwardly from one another (i.e. forming a trapezoidal shaped space underneath the resting surface 12), the distance D1 between their base leg bars 46 increases (i.e. becomes wider) as the length L1 of the leg components 40 is increased and as the height H1 of the table 10 is made higher. Greater stability for the table 10 and increased space below the resting surface 12 for the user (i.e. user's legs, torso, etc.) are thereby provided. Conversely, the distance D1 between the base leg bars 46 decreases (i.e. becomes narrower) as their length L1 is decreased and as the height H1 of the table 10 is made lower.

Referring to FIG. 10, a table adjustment mechanism 25 is coupled to the mounting bar 18. The table adjustment mechanism 25 provides angular or pitch adjustment of the table surface 12. The table adjustment mechanism 25 has an adjustment knob 30 rotatingly screwed and coupled to each end of the mounting bar 18 and a friction plate 22 having a concave friction surface attached to each end of the mounting bar 18. A washer ring 28 is coupled between the knob 30 and the friction plate 22 wherein frictional force is focused towards an outer perimeter of the friction plate 22 when the knob 30 is being tightened to hold the table surface 12 in place to a certain/desired position. The adjusting knobs 30 are loosened slightly to allow the resting surface 12 to be adjusted to a certain/desired angle and then the adjusting knobs 30 are tightened, thereby sandwiching the mounting side tabs 16 between the adjusting knobs 30 and the friction plates 22 coupled to the mounting bar 18. To increase the amount of friction, friction washers 28 are provided between the mounting side tabs 16 and the friction plates 22. Also, the friction plates 22 have a concave configuration (shown via dashed lines 22A) that maximizes the amount of friction so that the adjusting knobs 30 do not have to be tightened excessively or a large amount of turning force need not be applied against the mounting side tabs 16 to secure the resting surface 12 to the mounting bar 18 at a certain/desired angle. Furthermore, the mounting side tabs 16 are spring-biased outwardly toward the adjusting knobs 30 to provide tension against the adjusting knobs 30 thereby preventing the adjusting knobs 30 from becoming loosened inadvertently.

Figure 11:
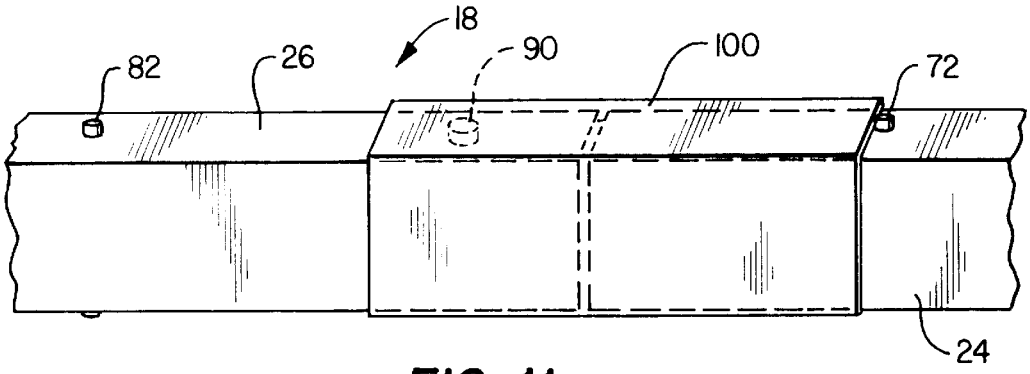
FIG. 11 is a partial side plan view of the mounting bar for the table of FIG. 2 showing the sleeve/rotational lock component in a locked position.
Figure 12:
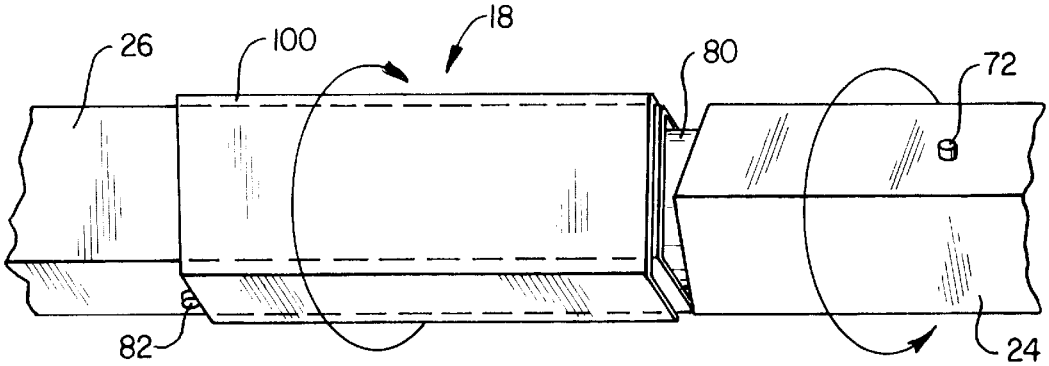
FIG. 12 is a partial side plan view of the mounting bar for the table of FIG. 2 showing the sleeve/rotational lock component in an unlocked position.
Figure 13:
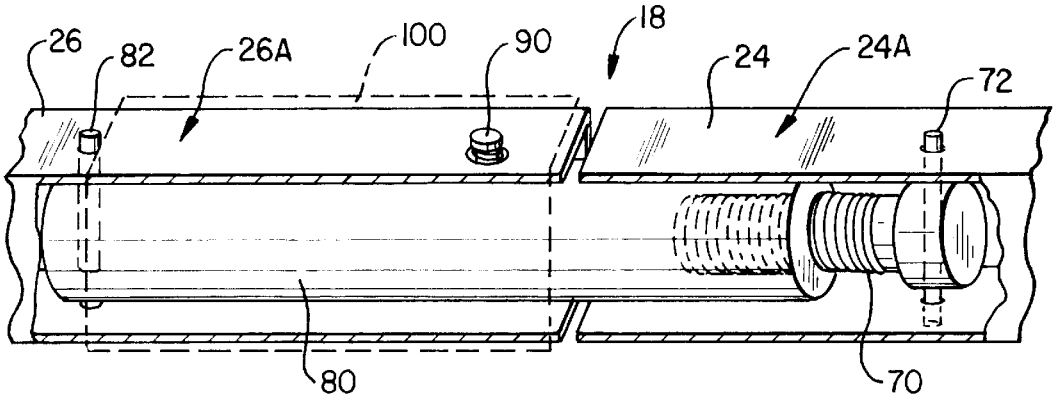
FIG. 13 is a partial side plan view of the mounting bar for the table of FIG. 2 showing the coupling components therein.
Figure 16:
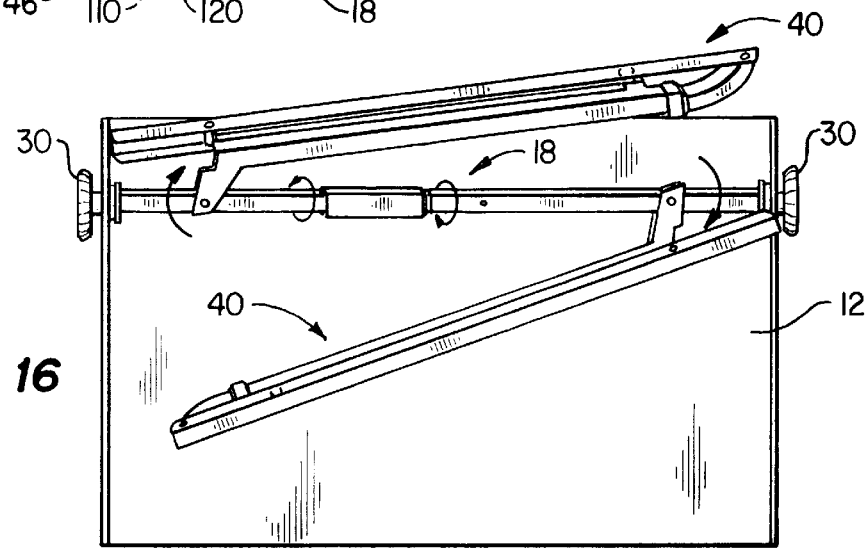
FIG. 16 is a bottom perspective view of the portable and adjustable table of FIG. 2 showing the leg components being rotated out of the way from each other and being folded to a storage position.

As shown in FIGS. 11–13, the mounting bar 18 has two bar portions, a first bar portion 24 and a second bar portion 26. The first bar portion 24 is coupled to a first leg component 40, and the second bar portion 26 is coupled to a second leg component 40 as shown in FIGS. 1 and 10. The second bar portion 26 rotates relative to the first bar portion 24 so that the second leg component 40 is able to rotate relative to the first bar portion 24 such that the second leg component 40 is out of the way of the first leg component 40 (i.e. a folding position) when the first leg component 40 and the second leg component 40 are being folded to the storage position as shown in FIG. 16. Furthermore, the second bar portion 26 rotates relative to the first bar portion 24 so that the first leg component and the second leg component 40 are able to rotate back to an unfolding position when the first leg component 40 and the second leg component 40 are being unfolded to a usable position.

Referring to FIG. 13, the first bar portion 24 has a screw 70 that is located and protrudes from and is securingly attached at an end 24A of the first bar portion 24 via an attaching pin 72. The second bar portion 26 further has a receiving thread portion 80 located and securingly attached at an end 26A of the second bar portion 26 via an attaching pin 82. The screw 70 rotates within the receiving thread portion 80 as shown in FIGS. 12 and 13 such that the first bar portion 24 rotates relative to the second bar portion 26. The first and second bar portions 24 and 26 are shown to be joined together and secured by threading the screw 70 into the thread portion 80. The screw 70 and thread portion 80 allow the first and second bar portions 24 and 26 to rotate opposite one another. A length of thread portion 80 is provided to allow sufficient rotation of the screw 70 therein such that the screw 70 does not lock up in rotation, that is, the first bar portion 24 will not lock tight with the second bar portion 26.

A locking sleeve or rotational lock component 100 is provided to allow the first and second bar portions 24 and 26 to rotate when the sleeve/lock component 100 is positioned or slid in a rotational unlock position as shown in FIG. 12. The first and second bar portions 24 and 26 are prevented from rotating when the sleeve/lock component 100 is positioned or slid in a rotational lock position as shown in FIG. 11. The rotational lock component 100 slides to both the first bar portion 24 and the second bar portion 26 to lock the first bar portion 24 and the second bar portion 26 into a rotational lock position (i.e. FIG. 11). The rotational lock component 100 slides away from the first bar portion 24 and to only the second bar portion 26 to a rotational unlock position (i.e. FIG. 12).

As shown in FIGS. 11 and 12, attaching pins 72 and 82 respectively protrude from the first bar portion 24 and the second bar portion 26 to provide stopping surfaces/mechanisms that provide a range of sliding movement for the sleeve/lock component 100 and prevent the sleeve/lock component 100 from moving beyond the desired locked and unlocked positions. A spring component 90 is embedded at a surface of the second bar portion 26 as shown in FIGS. 11, 12, and 13. The rotational lock component 100 is always located and slides over the spring component 90. The spring component 90 is in a spring bias position relative to the second bar portion 26, and it applies tension or spring bias between the second bar portion 26 and the sleeve/lock component 100 so that the rotational lock component 100 does not inadvertently or accidentally move or slide from the locked or unlocked position to which it has been positioned by the user.

Figure 14:
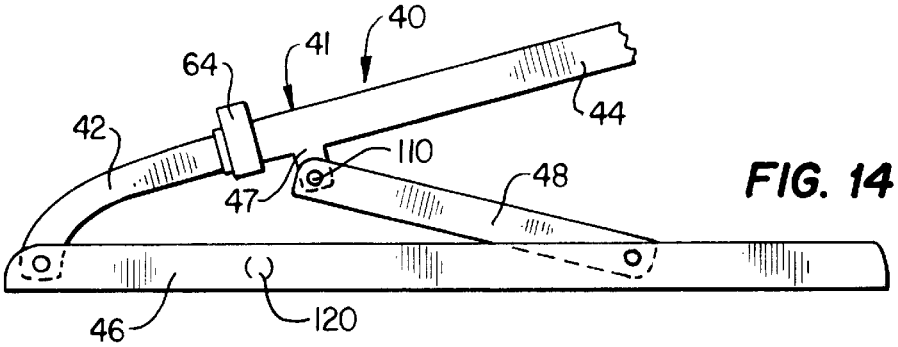
FIG. 14 is a side plan view of the leg component for the table of FIG. 2 showing the leg component partially expanded and unfolded.
Figure 15:
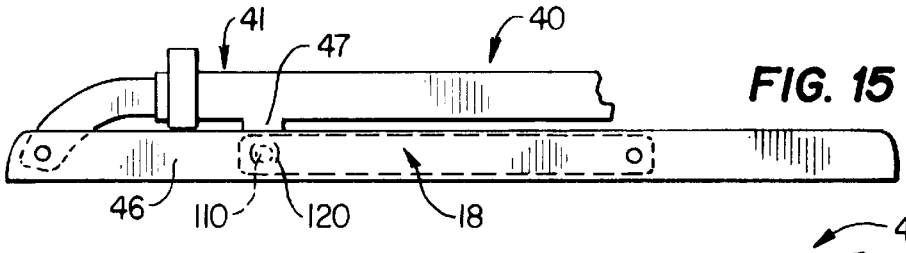
FIG. 15 is a side plan view of the leg component for the table of FIG. 2 showing the leg component folded and collapsed to a storage position.

As shown in FIGS. 14, 15, 16, and 17, the table 10 is able to fold into a compact form to allow for easy storage or transport and is able to easily expand and unfold into an usable position. The table 10 is folded by depressing the height adjustment components 64 to release the upper leg portions 44 of the slidably adjustable leg bars 41. The lower leg bar portions 44 are then inserted completely into the upper leg bar portions 42 thereby allowing the base leg bars 46 and cross support bars 48 of the leg components 40 to collapse and fold together with the upper leg bars 42. Locking detents or recesses 120 and respective locking protuberances 110 are provided to secure the leg components 40 in a closed, folded, or compacted configuration and storage position as shown in FIGS. 14 and 15. The protuberances 110 disengage from the detents/recesses 120 when the leg components 40 are being unfolded and expanded to an usable position.

Figure 17:
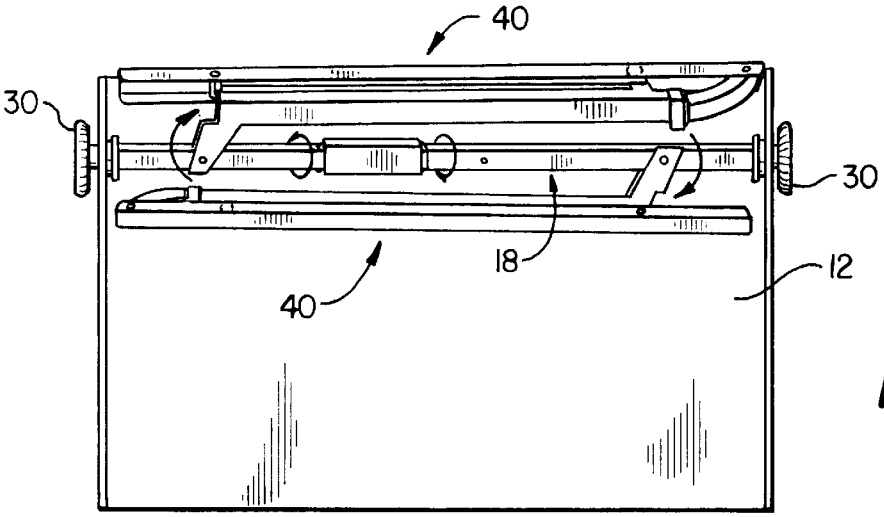
FIG. 17 is a bottom perspective view of the portable and adjustable table of FIG. 2 showing the leg components folded and neatly compacted to the storage position.

The folded and compacted leg components 40 are rotated out of the way from each other and folded inwardly along the mounting bar 18 under the table surface 12 as shown in FIG. 16. In order for these leg components 40 to rotate out of the way of each other, the sleeve/lock component 100 is then positioned to the rotational unlock position to allow the first and second bar portions 24 and 26 of the mounting bar 18 to be rotated opposite to and out of the way of one another thereby allowing the compacted leg components 40 to be rotated to achieve a neat and more compact configuration as shown in FIGS. 16 and 17. The rotational feature of the mounting bar 18 allows the first and second leg components to be folded neatly together such that they are generally parallel to each other and to the mounting bar 18 forming a generally straight folded assembly as shown in FIGS. 16 and 17. The rotational feature of the mounting bar 18 also allows the leg components 40 to be easily expanded or folded out to the usable position.

The preferred embodiment of the invention is described above in the Figures and Detailed Description. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiment was chosen and described in order to best explain the principles of the invention and its practical application and to enable others skilled in the art to best utilize the invention in various embodiments and with various modifications as are suited to the particular use contemplated.

What is claimed is:

1. An improved foldable leg assembly for supporting a table surface comprising:

a mounting bar adapted to receive the table surface, a first leg component foldably coupled to the mounting bar, and a second leg component foldably coupled to the mounting bar, wherein the first leg component and the second leg component are foldable to a storage position and unfoldable to an usable position and wherein the second leg component is able to rotate relative to at least one portion of the mounting bar so that the second leg component is out of a way of the first leg component when the first leg component and the second leg component are being folded to the storage position and so that the second leg component is able to rotate back relative to the at least one portion of the mounting bar when the first leg component and the second leg component are being unfolded to the usable position, and wherein the mounting bar comprises:

a first bar portion to which the first leg component is coupled, and a second bar portion to which the second leg component is coupled wherein the second bar portion rotates relative to the first bar portion so that the second leg component is able to rotate relative to the first bar portion such that the second leg component is out of the way of the first leg component when the first leg component and the second leg component are being folded to the storage position and so that the second leg component is able to rotate back relative to the first bar portion when the first leg component and the second leg component are being unfolded to a usable position.

2. The improved foldable leg assembly according to claim 1 wherein:

the first bar portion further comprises a screw located and attached by use of an attaching pin to a general end of the first bar portion, and the second bar portion further comprises a receiving threaded portion located and attached by use of another attaching pin at a general end of the second bar portion, wherein the screw rotates within the receiving threaded portion so that the first bar portion rotates relative to the second bar portion.

3. The improved foldable leg assembly according to claim 1 further comprises:

a rotational lock component slidingly coupled to the first bar portion and the second bar portion such that the rotational lock component is able to slide to both the first bar portion and the second bar portion to lock the first bar portion and the second bar portion into a rotational lock position and to slide the rotational lock component away from the first bar and to only the second bar to a rotational unlock position.

4. The improved foldable leg assembly according to claim 3 further comprises:

a spring component embedded at a surface of the second bar portion such that the rotational lock component is always located and is able to slide over the spring component such that the spring component holds the rotational lock component in a spring bias position to the second bar portion.

5. The improved foldable leg assembly according to claim 1 wherein the first leg component and the second leg component are each in a form of a truss shaped structure.

6. The improved foldable leg assembly according to claim 5 wherein the truss shaped structure further comprises:

a slidably adjustable support leg bar having a lower support leg portion and further having an upper support leg portion wherein the lower support leg portion inserts into the upper support leg portion and the upper support leg portion is slidably coupled over the lower support leg portion, a base leg bar hingedly coupled to the lower support leg portion of the slidably adjustable support leg bar, and a cross support leg bar hingedly coupled to both the upper support leg portion and the base leg bar such that the slidably adjustable support leg bar folds into and unfolds from the base leg bar.

7. The improved foldable leg assembly according to claim 6 wherein:

the slidably adjustable support leg bar further comprises at least one place lock protuberance located on an exterior surface thereat, and the base leg bar further comprises at least one place lock recess located on an interior surface thereat wherein the at least one place lock protuberance engages the at least one place lock recess when the slidably adjustable support leg bar is folded into and locked into place to the base leg bar.

8. The improved foldable leg assembly according to claim 1 further comprises:

height adjustment components each coupled to the first leg component and the second leg component wherein the height adjustment components allow adjustment of height of the first leg component and height of the second leg component.

9. The improved foldable leg assembly according to claim 8 further comprises:

height adjustment holes located on the lower support leg portions of the first leg component and the second leg component that allow the lower support leg portions to slidably move relative to the upper support leg portions of the first leg component and the second leg component, and wherein the height adjustment components each further comprises:

a hollow structure placed to surround an end of each of the upper support leg portions, an engaging protuberance coupled to an interior side of the hollow structure wherein the engaging protuberance engages into one of the adjustment holes when each of the height adjustment components is positioned into a height locked position and the engaging protuberance is disengaged from the one of the adjustment holes when each of the height adjustment components is in a height unlocked position, and a spring component having one end attached to another interior side of the hollow structure and having another end attached at each of the upper support leg portions wherein the spring component is compressed when pressure is applied on the hollow structure to disengage the engaging protuberance from the one of the adjustment holes and wherein the spring component is returned to a normal spring bias position when the pressure is released on the hollow structure to engage the engaging protuberance to one of the adjustment holes.

10. The improved foldable leg assembly according to claim 8 wherein the height adjustment components are independent height adjustment components that allow the first leg component and the second leg component to be adjusted independently in height to level a horizontal level plane of the mounting bar when the first leg component and the second leg component are placed on even and uneven surfaces.

11. The improved foldable leg assembly according to claim 1 wherein respective top ends of the first leg component and the second leg component are mounted a generally fixed top distance width of the mounting bar apart from each other and mounted outwardly angled relative to the mounting bar so that the first leg component and the second leg component outwardly angle relative to the mounting bar from the respective top ends to respective bottom ends and wherein an adjustable base distance width between the respective bottom ends of the first leg component and the second leg component increases as lengths of the first leg component and the second leg component increase and wherein the adjustable base distance width between the respective bottom ends of the first leg component and the second leg component decreases as the lengths of the first leg component and the second leg component decrease and wherein the adjustable base distance width is always greater than the fixed top distance width.

12. The improved foldable leg assembly according to claim 1 further comprises:

a table adjustment mechanism that allows angular adjustment of the table surface coupled to the mounting bar wherein the table adjustment mechanism comprises at least one adjustment knob rotatingly screwed and coupled to each end of the mounting bar and at least one friction plate having a concave friction surface attached to each end of the mounting bar and a washer ring coupled between the at least one knob and the at least one friction plate wherein frictional force is focused towards an outer perimeter of the friction plate when the at least one knob is being tightened to hold the table surface in place.

13. The improved foldable leg assembly according to claim 1 further comprises:

the first leg component and the second leg component outwardly and angularly coupled to the mounting bar.

14. An improved leg assembly for a table comprising:

a mounting bar adapted to receive a table surface, at least two height adjustable legs coupled to the mounting bar wherein respective top ends of the at least two height adjustable legs are mounted a generally fixed top distance width of the mounting bar apart from each other and mounted outwardly angled relative to the mounting bar so that the at least two height adjustable legs outwardly angle relative to the mounting bar from the respective top ends to respective bottom ends and wherein an adjustable base distance width between the respective bottom ends of the at least two adjustable legs increases as lengths of the at least two adjustable legs increase and wherein the adjustable base distance width between the respective bottom ends of the at least two adjustable legs decreases as the lengths of the at least two adjustable legs decrease and wherein the adjustable base distance width is always greater than the fixed top distance width.

15. A method of folding and unfolding an improved foldable leg assembly that supports a table surface comprising the steps of:

providing the foldable leg assembly with a mounting bar adapted to receive the table surface, a first foldable leg component hingedly coupled to the mounting bar, and a second foldable leg component hingedly coupled to the mounting bar, collapsing the first leg component and the second leg component each to a folded position, rotating the second leg component relative to the first leg component so that the second leg component is rotated out of a way of the first leg component when the first leg component and the second leg component are being folded to a storage position, rotating the second leg component relative to the first leg component so that the first leg component and the second leg component are able to rotate back to an unfolding position when the first leg component and the second leg component are being unfolded to an usable position, expanding the first leg component and the second leg component each to an unfolded position, providing a first bar for the mounting bar to which the first leg component is counted, providing a second bar for the mounting bar to which the second leg component is coupled, and rotating the first bar relative to the second bar so that the first leg component and the second leg component are rotatable moved between the storage position and the usable position.

16. A method of using an improved leg assembly for a table comprising the steps of:

providing the improved leg assembly with a mounting bar having a table surface attached thereto and at least two height adjustable legs coupled to the mounting bar, mounting respective top ends of the at least two height adjustable legs a generally fixed ton distance width of the mounting bar apart from each other and mounting the respective top ends relative to the mounting bar so that the at least two height adjustable legs outwardly angle relative to the mounting bar from the respective top ends to respective bottom ends, increasing lengths of the at least two height adjustable legs to make the table surface higher thereby increasing an adjustable base distance width between the respective bottom ends of the at least two adjustable legs, decreasing lengths of the at least two height adjustable legs to make the table surface lower thereby decreasing the adjustable base distance width between the respective bottom ends of the at least two adjustable legs, and maintaining the adjustable base distance width always greater than the fixed top distance width.

17. A table with an improved foldable leg assembly comprising:

a mounting bar, a table surface coupled to the mounting bar, a first leg component coupled to the mounting bar, a second leg component coupled to the mounting bar such that the second leg component is able to rotate relative to the first leg component when the first leg component and the second leg component are folded to a storage position so that the second leg component is out of a way of the first leg component when the first leg component and the second leg component are being folded to the storage position and are unfolded to an usable position so that the first leg component and the second leg component are able to rotate back to an unfolding position when the first leg component and the second leg component are being unfolded to the usable position, a first bar portion to which the first leg component is coupled, and a second bar portion to which the second leg component is coupled wherein the second bar portion rotates relative to the first bar portion so that the second leg component is able to rotate relative to the first bar portion such that the second leg component is out of the way of the first leg component when the first leg component and the second leg component are being folded to the storage position and so that the second leg component is able to rotate back relative to the first bar portion when the first leg component and the second leg component are being unfolded to the usable position.

18. The table according to claim 17 further comprises:

height adjustment holes located on lower leg portions of the first leg component and the second leg component that allow the lower leg portions to slidably move relative to upper leg portions of the first leg component and the second leg component, and wherein the height adjustment components are each coupled to the first leg component and the second leg component wherein the height adjustment components allow adjustment of height of the first leg component and height of the second leg component and each of the height adjustment components further comprises:

a hollow structure placed to surround an end of each of the upper leg portions, an engaging protuberance coupled to an interior side of the hollow structure wherein the engaging protuberance engages into one of the adjustment holes when each of the height adjustment component is positioned into a height locked position and the engaging protuberance is disengaged from the one of the adjustment holes when each of the height adjustment component is in a height unlocked position, and a spring component having one end attached to another interior side of the hollow structure and having another end attached at the one of the upper leg portions wherein the spring component is compressed when pressure is applied on the hollow structure to disengage the engaging protuberance from the one of the adjustment holes and wherein the spring component is returned to a normal spring bias position when the pressure is released on the hollow structure to engage the engaging protuberance to one of the adjustment holes.

19. The table according to claim 18 wherein the height adjustment components are independent height adjustment components that allow the first leg component and the second leg component to be adjusted independently in height to level a horizontal level plane of the mounting bar when the first leg component and the second leg component are placed on even and uneven surfaces.

20. The table according to claim 17 wherein respective top ends of the first leg component and the second leg component are mounted a generally fixed top distance width of the mounting bar apart from each other and mounted outwardly angled relative to the mounting bar so that the first leg component and the second leg component outwardly angle relative to the mounting bar from the respective too ends to respective bottom ends and wherein an adjustable base distance width between the respective bottom ends of the first leg component and the second leg component increases as lengths of the first leg component and the second leg component increase and wherein the adjustable base distance width between the respective bottom ends of the first leg component and the second leg component decreases as the lengths of the first leg component and the second leg component decrease and wherein the adjustable base distance width is always greater than the fixed ton distance width.

21. The table according to claim 17 further comprises:

a table adjustment mechanism coupled to the mounting bar and the table surface wherein the table adjustment mechanism has at least one adjustment knob rotatingly screwed and coupled to each end of the mounting bar and at least one friction plate having a concave friction plate attached to each end of the mounting bar and a washer ring coupled between the at least one knob and the at least one friction plate wherein frictional force is focused towards an outer perimeter of the friction plate when the at least one knob is being tightened to hold the table surface to the mounting bar.

22. An improved foldable leg assembly for supporting a table surface comprising:

a mounting bar adapted to receive the table surface, a first leg component foldably coupled to the mounting bar, a second leg component foldably coupled to the mounting bar, and height adjustment components each coupled to the first leg component and the second leg component wherein the height adjustment components allow adjustment of height of the first leg component and height of the second leg component, wherein the first leg component and the second leg component are foldable to a storage position and unfoldable to an usable position and wherein the second leg component is able to rotate relative to at least one portion of the mounting bar so that the second leg component is out of a way of the first leg component when the first leg component and the second leg component are being folded to the storage position and so that the second leg component is able to rotate back relative to the at least one portion of the mounting bar when the first leg component and the second leg component are being unfolded to the usable position, and wherein respective top ends of the first leg component and the second leg component are mounted a generally fixed top distance width of the mounting bar apart from each other and mounted outwardly angled relative to the mounting bar so that the first leg component and the second leg component outwardly angle relative to the mounting bar from the respective top ends to respective bottom ends and wherein an adjustable base distance width between the respective bottom ends of the first leg component and the second leg component increases as lengths of the first leg component and the second leg component increase and wherein the adjustable base distance width between the respective bottom ends of the first leg component and the second leg component decreases as the lengths of the first leg component and the second leg component decrease and wherein the adjustable base distance width is always greater than the fixed top distance width.

23. The improved foldable leg assembly according to claim 22 wherein the first leg component and the second leg component are each in a form of a truss shaped structure.

24. The improved foldable leg assembly according to claim 22 wherein the truss shaped structure further comprises:

a slidably adjustable support leg bar having a lower support leg portion and further having an upper support leg portion wherein the lower support leg portion inserts into the upper support leg portion and the upper support leg portion is slidably coupled over the lower support leg portion, a base leg bar hingedly coupled to the lower support leg portion of the slidably adjustable support leg bar, and a cross support leg bar hingedly coupled to both the upper support leg portion and the base leg bar such that the slidably adjustable support leg bar folds into and unfolds from the base leg bar.

25. The improved foldable leg assembly according to claim 23 wherein:

the slidably adjustable support leg bar further comprises at least one place lock protuberance located on an exterior surface thereat, and the base leg bar further comprises at least one place lock recess located on an interior surface thereat wherein the at least one place lock protuberance engages the at least one place lock recess when the slidably adjustable support leg bar is folded into and locked into place to the base leg bar.

26. The improved foldable leg assembly according to claim 22 further comprises:

height adjustment holes located on the lower support leg portions of the first leg component and the second leg component that allow the lower support leg portions to slidably move relative to the upper support leg portions of the first leg component and the second leg component, and wherein the height adjustment components each further comprises:

a hollow structure placed to surround an end of each of the upper support leg portions, an engaging protuberance coupled to an interior side of the hollow structure wherein the engaging protuberance engages into one of the adjustment holes when each of the height adjustment components is positioned into a height locked position and the engaging protuberance is disengaged from the one of the adjustment holes when each of the height adjustment components is in a height unlocked position, and a spring component having one end attached to another interior side of the hollow structure and having another end attached at each of the upper support leg portions wherein the spring component is compressed when pressure is applied on the hollow structure to disengage the engaging protuberance from the one of the adjustment holes and wherein the spring component is returned to a normal spring bias position when the pressure is released on the hollow structure to engage the engaging protuberance to one of the adjustment holes.

27. The improved foldable leg assembly according to claim 22 wherein the height adjustment components are independent height adjustment components that allow the first leg component and the second leg component to be adjusted independently in height to level a horizontal level plane of the mounting bar when the first leg component and the second leg component are placed on even and uneven surfaces.

* * * * *